US006288300B1

(12) United States Patent
Lemus et al.

(10) Patent No.: US 6,288,300 B1
(45) Date of Patent: Sep. 11, 2001

(54) THERMAL TREATMENT AND IMMOBILIZATION PROCESSES FOR ORGANIC MATERIALS

(75) Inventors: Miriam Lemus, Greenbelt; Aaron Barkatt; Marta Gmurczyk, both of Silver Spring, all of MD (US); Galina Cherepakhov, Cliffside Park, NJ (US)

(73) Assignee: Consolidated Edison Company of New York, Inc., New York, NY (US)

( * ) Notice: Subject to any disclaimer, the term of this patent is extended or adjusted under 35 U.S.C. 154(b) by 0 days.

(21) Appl. No.: 09/357,346

(22) Filed: Jul. 14, 1999

Related U.S. Application Data

(63) Continuation-in-part of application No. 08/713,243, filed on Sep. 12, 1996, now Pat. No. 6,084,146.

(60) Provisional application No. 60/092,825, filed on Jul. 14, 1998.

(51) Int. Cl.[7] ..... G21F 9/00

(52) U.S. Cl. ..... 588/1; 588/5; 588/10; 588/11; 588/14; 588/15; 588/19; 588/20; 588/205; 588/257

(58) Field of Search ..... 588/1, 20, 205, 588/228, 5, 10, 11, 14, 15, 19, 257

(56) References Cited

U.S. PATENT DOCUMENTS

| | | | | |
|---|---|---|---|---|
| 2,728,696 | | 12/1955 | Singer . | |
| 3,944,683 | | 3/1976 | Church et al. . | |
| 4,014,766 | | 3/1977 | Watanabe et al. . | |
| 4,086,182 | | 4/1978 | Hengelhaupt et al. . | |
| 4,108,769 | | 8/1978 | Krieg et al. . | |
| 4,118,243 | | 10/1978 | Sandesara . | |
| 4,241,039 | | 12/1980 | Koh et al. . | |
| 4,318,788 | | 3/1982 | Duffey . | |
| 4,343,706 | | 8/1982 | Etzel et al. . | |
| 4,369,073 | | 1/1983 | Fukutsuka et al. . | |
| 4,389,254 | | 6/1983 | Tusset et al. . | |
| 4,427,034 | | 1/1984 | Nagata et al. . | |
| 4,454,098 | | 6/1984 | Scheithauer et al. . | |
| 4,508,641 | | 4/1985 | Hanulik . | |
| 4,518,508 | | 5/1985 | Conner . | |
| 4,601,832 | | 7/1986 | Hooykaas . | |
| 4,606,829 | | 8/1986 | Rice et al. . | |
| 4,642,203 | | 2/1987 | Matsunaga et al. . | |
| 4,642,204 | | 2/1987 | Burstrom et al. . | |
| 4,649,019 | | 3/1987 | Jawor . | |
| 4,680,126 | | 7/1987 | Franard et al. . | |
| 4,693,798 | | 9/1987 | Gale et al. . | |
| 4,726,895 | | 2/1988 | Martinez . | |
| 4,834,917 | | 5/1989 | Ramm et al. . | |
| 4,970,079 | | 11/1990 | Hem et al. . | |
| 5,013,453 | | 5/1991 | Walker . | |
| 5,073,305 | | 12/1991 | Miyao et al. . | |
| 5,093,007 | | 3/1992 | Domvile . | |
| 5,106,508 | | 4/1992 | Schwitzgebel . | |
| 5,177,305 | * | 1/1993 | Pichat | 588/257 |
| 5,221,323 | | 6/1993 | Li . | |
| 5,252,003 | | 10/1993 | MoGahan . | |
| 5,290,589 | | 3/1994 | Clough et al. . | |
| 5,292,435 | | 3/1994 | Schwitzgebel . | |
| 5,302,565 | * | 4/1994 | Crowe | 501/141 |
| 5,326,439 | | 7/1994 | Brewster . | |
| 5,330,658 | | 7/1994 | Grant et al. . | |
| 5,352,517 | | 10/1994 | Clough et al. . | |
| 5,358,643 | | 10/1994 | McClintock . | |
| 5,505,857 | | 4/1996 | Misra et al. . | |
| 5,520,917 | | 5/1996 | Mizuguchi et al. . | |
| 5,678,235 | * | 10/1997 | Crowe | 588/9 |
| 5,731,564 | * | 3/1998 | Kujawa et al. | 219/121.36 |

FOREIGN PATENT DOCUMENTS

| | | | |
|---|---|---|---|
| 63-127199 | * | 2/1968 | (JP) . |
| 63-22598 | * | 2/1968 | (JP) . |
| 63-98599 | | 4/1988 | (JP) . |

OTHER PUBLICATIONS

Matsuda, Masami et al., "Effect of Metallic Impurities on Oxidation Reaction of Ion Exchange Resin (I)", Journal of Nuclear Science and Technology 23(3), pp. 244–252 (Mar. 1986).

Matsuda, Masami et al., "Effect of Metallic Impurities of Ion Exchange Resin Oxidation Rate", Journal of Nuclear Science and Technology 22(3), pp. 241–243 (Mar. 1985).

Chino, K. et al., "Incineration of Ion–Exchange Resins Using a Cocentric Burner", New Strategies for Low–Level Waste Management, Transactions of the American Nuclear Society, vol. 44, pp. 434–435 (1983); and Valkianinen, M.; Nykyri,M., "Incineration of Ion Exchange Resins in a Fluidized Bed", Nuclear Technology, vol. 58, pp. 248–255, (Aug. 1982).

"Fixation of High Level Solid Wastes (HLSW) in a $TI0_2$ Base Ceramic Matrix Provided With An Integrated Overpack"; Bauer et al., Mat. Res. Soc. Symp. Proc. Vol. 15 (1983), pp. 71–75.

(List continued on next page.)

*Primary Examiner*—Ngoclan Mai
(74) *Attorney, Agent, or Firm*—Morgan & Finnegan, LLP

(57) ABSTRACT

Organic materials are mixed with metal oxide, such as hydrated metal oxides, prior to or during heat treatments in aerated or oxygenated environments to stabilize thermal decomposition or incineration of the organic materials and to suppress the emission of volatile, hazardous organic compounds. The organic materials may be ion exchange resins and polymeric sorbents, for example, and include contaminated materials such as hazardous wastes. The hydrated metal oxides may be hydrated ferric oxide, hydrated aluminum oxide or hydrated titania oxide, for examples. Ferrihydrite is preferred. The heat treatment may be a preparation for a waste disposal process, such as immobilization in ferric oxide, cement, concrete, a polymer, bitumen or glass, for example. Immobilization processes in ferric oxide are also discussed, including the use of additives such as magnesium oxide, ammonium dihydrogen phosphate and phosphoric acid, enabling consolidation at room temperature and pressures less than 15,000 psi.

46 Claims, 4 Drawing Sheets

OTHER PUBLICATIONS

"Immobilization of Wastes in a Ferric Oxide Matrix—A Laboratory Study"; Marta U. Gmurczyk et al., EPRI International Low Level Waste Conference, Jul. 15, 1998, pp. 1–31.

"Synroc Production Using A Fluid Bed Calciner" Ackerman et al., Mat. Res. Soc. Symp. Proc. vol. 15, (1983), pp. 63–71.

"Steam Generator Sludge at the Indian Point 2 Nuclear Station: Implications to Tube Corrosion" A. Barkatt et al., Corrosion 95, The NACE Annual Conference and Corrosion Show, Paper No. 453 pp. 453/1–453/9; Mar. 1995.

"Characterization of Sludge from Indian point 2", A. Barkatt et al., EPRI PWR Sludge Management Workshop, pp. 21–1—21–17; May 1994.

"Composition, Characteristics and Study of Sludge Formation in the Indian Point 2 PWR Steam Generators", A Barkatt et al., Corrosion 93, The NACE Annual Conference and Corrosion Show, Paper No. 365, pp. 365/1—365/6; 1993.

"Characterization and Simulation of Hematite–Rich Deposits in PWR Steam Generators", A. Barkatt et al., NE–vol. 8, Steam Generator Sludge Deposition in Recirculating and Once Through Steam Generator Upper Tube Bundle and Support Plates, eds. R.L. Baker et al., ASME, New York, N.Y., pp. 69–73; 1992.

"Studies of the Properties and Build–Up of Hard Sludge at Indian Point 2", A. Barkatt et al., EPRI PWR Plant Chemists' Meeting, Nov. 1992.

"Immobilisation of high level nuclear reactor wastes in SYNROC", A.E. Ringwood et al., Nature, vol. 278, pp. 219–223; Mar. 15, 1979.

"The SYNROC process: A geochemical approach to nuclear waste immobilization", A.E. Ringwod et al., Geochemical Journal, vol. 13, pp. 141–165; 1979.

"Evolution, Composition and Properties of Steam Generator Sludge at Indian Point 2: Modeling and Observations", A. Barkatt, Proceedings: PWR Plant Chemistry Meeting, vol. 2, Sessions 4–8; Feb. 1996, based on a presentation given Nov. 1–3, 1995.

* cited by examiner

THERMAL TREATMENT AND IMMOBILIZATION PROCESSES FOR ORGANIC MATERIALS

The present application is a continuation-in-part of U.S. Ser. No. 08/713,243, filed on Sep. 12, 1996, assigned to the assignee of the present invention U.S. Pat. No. 6,084,146 and incorporated by reference herein. The present application also claims the benefit of U.S. Provisional Application No. 60/092,825, filed on Jul. 14, 1998, assigned to the assignee of the present invention and incorporated by reference herein.

FIELD OF THE INVENTION

The present invention relates to the thermal processing of organic materials and, more particularly, the thermal processing of organic materials, such as ion exchange resins and polymeric sorbents, in the presence of metal oxides, such as hydrated ferric oxide. The invention also relates to processes for immobilizing organic materials, including hazardous wastes.

BACKGROUND OF THE INVENTION

Ion exchange resins are synthetic, porous organic solids, typically having a polystyrene matrix, acidic or basic groups bonded to the matrix and hydrogen or sodium ions bonded to the acidic or basic groups. They are effective chemical filters for hazardous wastes in contaminated water, for example, which may include radioactive and non-radioactive materials. Polymeric sorbents, such as charcoal, have a charged surface and are also effective chemical filters of such wastes. However, the use of these materials to absorb hazardous wastes presents the problem of the effective disposal of the contaminated ion exchange resins and polymeric sorbents.

U.S. Ser. No. 08/713,243, filed on Sep. 12, 1996, assigned to the assignee of the present invention and incorporated by reference, herein, discloses a process for the immobilization of radioactive and other hazardous wastes with ferric oxides such as ferrihydrite. It was demonstrated that ion exchange resins and polymeric sorbents, and other contaminated materials, may be effectively immobilized by mixing the contaminated resin or sorbent with hydrated ferric oxide comprising at least 20% $Fe_2O_3$, by dry weight of the total weight of the mixture. The mixture was pressed at temperatures of about 260° C. A large part of the water was removed while the mixture was under pressure of 70,000 psi for a period of time to produce a solid composition containing the contaminated material. Such a mixture was successfully consolidated at a pressure of 25,000 psi, with the addition of additives such as metallic fines. Prior to mixing with the hydrated ferric oxide, the ion exchange resin or polymeric sorbent was dried by heating, as well as ground to reduce its particle size. In the Examples, the cation ion exchange resin was dried at 120° C. while the polymeric sorbent was dried at 118° C.

Volume reduction is an important economic consideration in hazardous waste disposal because the volume of the waste to be disposed is a significant factor in the burial cost. The pressure and temperature of a disposal process are also important economic considerations because of their impact on processing costs. In U.S. Ser. No. 08/713,243, volume reductions of up to 10 times for ion exchange resins were achieved by pressing at 70,000 psi and 260° C. The volume of the ion exchange resins and polymeric sorbents immobilized for disposal in accordance with U.S. Ser. No. 08/713,243 could be further decreased by preheating the resin or sorbents at higher temperatures. However, thermal processing of organic solids tends to proceed in an uneven manner, resulting in local hot spots of material. Such hot spots can cause local eruptions and popping in the sample, and enhance the emission of hazardous organic compounds, such as the products of incomplete combustion ("PICs"). Such emissions create serious health risks. Heating ion exchange resins in particular causes the loss of sorbed volatiles and moisture followed by partial decomposition of the resin itself and further volatilization. Cation exchange resins are stable up to about 120° C., while anion exchange resins are stable only up to about 60° C.

Incineration and thermal decomposition have also been proposed for the immobilization and volume reduction of hazardous wastes. Incineration, for example, is discussed in "Incineration of Ion-Exchange Resins in a Fluidized Bed", Valkiainen, et al., Nuclear Technology, Vol. 58, August 1982, pp. 248–255; and "Incineration of Ion-Exchange Resins Using a Cocentric Burner", Chino et al., Transactions of the American Nuclear Society, 44, (1983), pp. 434–435. However, when processed at sufficiently high temperatures to cause decomposition in an aerated or oxygenated environment, which is typical in incineration and thermal decomposition processes, ion exchange resins and polymer sorbents undergo the same thermal instabilities discussed above. Similarly, disposal procedures including heat treatments for other organic polymers and plastics, which form a large part of the solid wastes generated by human activity, present such problems.

Vitrification is another disposal technique, wherein the waste material is mixed with metal oxide, such as sodium oxide, calcium oxide or boron oxide, and silica at temperatures over 800° C. to form a glass for immobilizing the residues of the waste material. Because of the high temperatures involved, vitrification is an expensive, complex procedure.

It would be advantageous to avoid the thermal instabilities caused by high temperature processing of organic materials in aerated or oxygenated environments. It would also be advantageous to decrease the pressures and temperatures used in waste disposal processes.

SUMMARY OF THE INVENTION

It has been found that the presence of metal oxides, such as hydrated metal oxides, during the thermal decomposition of organic materials in air or oxygen enables their thermal decomposition to proceed more smoothly and minimizes the evolution of undesirable and hazardous vapors and fumes.

In accordance with one embodiment of the present invention, prior to or concurrent with a heat treatment, the organic materials are mixed with the hydrated metal oxide. The heat treatment can be the incineration or thermal decomposition of the organic materials. Preferably, the hydrated metal oxide is added to the organic materials prior to the start of thermal decomposition. Thermal treatments at temperatures above that which cause the onset of decomposition for that material can then proceed with more even heating of the organic materials, resulting in fewer local eruptions, less popping and decreased emission of volatile, hazardous organic compounds, such as the products of incomplete combustion ("PICs"), up to about 500° C. Preferably, the heat treatment is conducted between about 300° C. to about 450° C. In addition to the ion exchange resins, the organic materials which may be heat treated in accordance with the present invention include ion exchange resins, polymeric sorbents, other polymers and plastics. The organic materials may be waste material such as hazardous wastes, radioactive wastes or municipal wastes, for example.

The hydrated metal oxide may be hydrated ferric oxide, hydrated aluminum oxide or hydrated titanium oxide, for example. Ferrihydrite is preferred.

In accordance with another embodiment of the present invention, the thermal treatment of a mixture of organic materials and a metal oxide is part of a process for immobilizing the organic materials in a matrix of ferric oxide. Either the metal oxide mixed with the organic materials is hydrated ferric oxide or hydrated ferric oxide is added to the heat treated mixture. The heat treated mixture is pressed for a period of time to remove a large part of the water content to produce a solid composition. Preferably, the pressing step is performed at room temperature. Higher temperatures may also be used. The pressing step can take place at about 70,000 psi, for example. The required pressure can be lowered by the addition of certain additives, such as magnesium oxide and ammonium dihydrogen phosphate, prior to pressing. Preferably, with the addition of additives, the pressure of the pressing step is less than about 30,000 psi. More preferably, the pressure is less than about 15,000 psi.

In accordance with another embodiment of the invention, contaminated materials are consolidated in a matrix of ferric oxide by mixing the contaminated materials with hydrated ferric oxide comprising at least about 20% $Fe_2O_3$ by dry weight of the total weight of the mixture, and pressing the mixture and gradually removing a large part of the water present in the mixture at room temperature for a period of time to produce a solid composition. Pressures less than 30,000 psi and more preferably less than 15,000 psi may be used with the addition of additives.

DETAILED DESCRIPTION OF THE INVENTION

Figure 1:
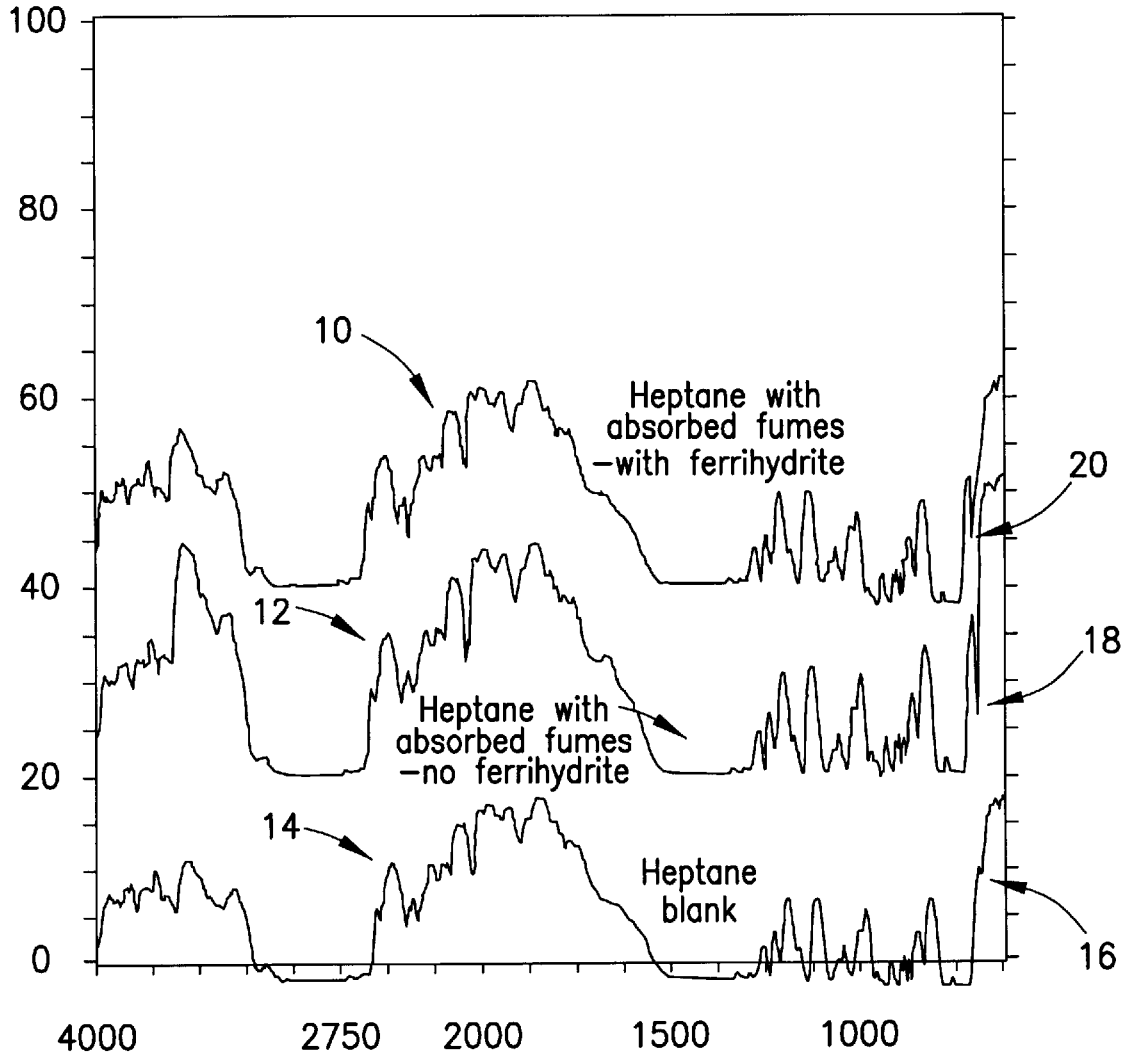
FIG. 1 shows two infrared ("IR") absorption spectra for solutions of fumes resulting from the thermal decomposition of ion exchange resin absorbed in heptane, wherein the resin was mixed with ferrihydrite and was not mixed with metal oxide, respectively, and one absorption spectrum of a heptane blank.

In accordance with the present invention, organic materials are mixed with a metal oxide, such as a hydrated metal oxide, prior to or concurrent with a heat treatment in an aerated or oxygenated environment. The heat treatment can be the incineration or the thermal decomposition of the organic materials, for example. Preferably, the metal oxide is added prior to the start of the thermal decomposition of the organic materials.

The hydrated metal oxide may be hydrated ferric oxide, hydrated aluminum oxide or hydrated titanium oxide, for example. It is also preferred that the hydrated metal oxide not contain free-standing water, to avoid any additional volatilization caused by the water.

Metal oxide for use in the invention can be prepared by adding a base to a solution of a metal salt at a pH in the near-neutral or alkaline range. For example, a slurry of hydrated ferric oxide may be prepared by adding a base to a solution of a ferric salt. A pH of between about 7.5–8 has been found to enable more complete precipitation at a faster rate, yielding fine particles. The base is preferably a solution of ammonium hydroxide and the ferric salt is preferably ferric nitrate ($Fe(NO_3)_3$). The base is preferably added slowly and with stirring to the salt. For example, a concentrated solution of ammonia can be slowly added to a solution containing approximately 28% of ferric nitrate in water with stirring until the pH reaches about 2.5–8. The reaction can be conducted at room temperature. It has been found that under these conditions a majority of the hydrated ferric oxide is in the form of ferrihydrite, which is preferred. The resulting slurry typically contains about 10 grams of suspended ferric oxide precipitate by dry weight per 100 milliliters of aqueous solution.

Hydrated aluminum oxide may be prepared in a similar manner, starting with an aluminum salt such as aluminum nitrate. Hydrated aluminum oxide (alumina) is also commercially available. Hydrated titania oxide may be similarly prepared by precipitation from a solution containing titanate or an organotitanium compound.

The slurry is preferably filtered to separate as much of the free-standing water as possible. Coarse filter paper or a mesh screen with a mesh size of about −200 may be used to separate particles of less than about 75 microns for subsequent use in the process of the invention.

If the organic material is solid organic material, the solids are preferably in the form of particles no larger than about 50 microns, for better mixing with the hydrated metal oxide. More preferably, the particles are less than about 10 microns. Grinding at moderate temperatures may be used to reduce the particle size, if necessary. Due to the volatility of the organic materials, temperatures just at or below the temperature causing the onset of thermal decomposition are preferred. In the case of cation exchange resins, particle size reduction by a combination of grinding and drying at a temperature of about 120° C. has been found to be most effective. Particle size may also be reduced during mixing of the organic solids with the hydrated metal oxide by mixing techniques such as ball milling. The metal oxide and organic material may also be mixed by other conventional processes, such as blade mixers or air jets. The organic material and the metal oxide are preferably uniformly mixed prior to the start of the heat treatment.

The hydrated metal oxide is preferably added to the organic materials prior to the start of heat treatment. It may be added during the heat treatment as well, but for the full advantages of the invention, it is preferable to add the hydrated metal oxide at least prior to the start of thermal decomposition of the organic solids. The heat treatment can take place in an oven under an aerated or oxygen environment. The oven should be equipped with an air filtration system to remove particles from the exhaust gas.

The addition of metal oxide becomes particularly useful with heat treatments above the temperature causing the onset of decomposition of the organic materials, particularly temperatures significantly above that temperature, where thermal decomposition occurs more rapidly. For example, with cation exchange resins, the invention has shown itself to be particularly useful above about 120° C., and more particularly, at above about 200° C. With anion exchange resins, the invention is expected to be useful at temperatures above about 60° C. Heat treatments up to about 500° C. may be efficiently controlled in accordance with the present invention. Some improvement in avoiding thermal instabilities may be obtained above 500° C., as well. The preferred temperature range for use of the process of the invention is about 300° C. to about 450° C.

The greater the amount of metal oxide added to the organic materials, the greater the suppression of thermal instabilities. However, in the context of waste disposal, the presence of the metal oxide could decrease the volume reduction which can be achieved. Therefore, when determining the actual proportions of metal oxide and organic materials, the temperature of the heat treatment and the desired amount of volume reduction should be considered. The amount of hydrated metal oxide mixed with the organic materials is preferably about 10% to about 50% of the total weight of the mixture.

The heat treatment of the organic materials can be a preparation to immobilization in hydrated ferric oxide, as described in U.S. Ser. No. 08/713,243, which is incorporated by reference, herein and discussed further, below. The heat treated organic materials may also be immobilized in cement, concrete, polymers such as polyethylene, bitumen or glass, for example, as is known in the art. The heat treated organic materials may also be packed in a high-integrity storage container. The heat treatment could also be part of another chemical process, such as oxidation reactions for forming charcoal or for fuel conversion.

In Examples 1 and 2, below, it is shown that mixing ion exchange resins and polymeric sorbents with hydrated ferric oxide such as ferrihydrite or hydrated aluminum oxide resulted in smoother thermal decomposition. Upon addition of 10–50% of the hydrated metal oxide to these organic solids, the formation of hot spots was largely suppressed. In the absence of such hydrated metal oxides, heating ion exchange resins and polymeric sorbents to temperatures between 200° C. and 500° C. gave rise to many hot spots and eruptions in localized areas of the resin.

It is believed that the presence of metal oxides, such as hydrated ferric oxide and hydrated aluminum oxide, improves the thermal conductivity of the mixture, decreasing the local overheating and resulting local eruptions, popping and emission of volatile organic solids. The metal oxides may also absorb or react with the aromatic PICs.

EXAMPLE 1

CN-200 is a nuclear grade cation exchange resin, widely used in the nuclear industry. The resin was milled and passed through a 200-mesh sieve. A quantity of 1.0 gram of the resin was placed in a 25-milliliter porcelain crucible. The crucible was heated in a box furnace at a temperature of 450° C. for 5 minutes.

Numerous red, glowing hot spots were observed during this period of time, with occasional popping phenomena and small eruptions. The thermally decomposing resin gave rise to thick white fumes with a strong acrid odor typical of burning plastic materials. experiment was then repeated with the addition of 0.5 grams of ferrihydrite to 1.0 gram of CN-200, milled and sieved, as described above. The ferrihydrite was precipitated from a solution of ammonium hydroxide by the addition of ferric nitrate, as described above. The mixture was placed in a crucible and heated in the box furnace at a temperature of 450° C. for 5 minutes. The hot spots and the popping were largely suppressed, smoke evolution was much weaker and no acrid smell was detected.

The experiment was repeated using hydrated aluminum oxide prepared by precipitation from aluminum nitrate solution. The effects of hydrated aluminum oxide on the thermal decomposition of the ion exchange resin were found to be similar to those observed with ferrihydrite.

Similar sets of experiments was carried out using polystyrene, melt index 14, available from Aldrich Chemical Co., Milwaukee, Wis., Cat. No. 43,011-0, and poly (styrenesulfonic acid-co-maleic acid) sodium salt, also available from Aldrich Chemical Co., Cat. No. 43,456-6, mixed with ferrihydrite. The results of these two sets of experiments were similar to those obtained with the ion exchange resin.

EXAMPLE 2

In order to determine more quantitatively the effect of the presence of a metal oxide such as ferrihydrite on thermal decomposition, a set of experiments was performed to compare the thermal decomposition of an ion exchange resin in the absence and in the presence of ferrihydrite, respectively. The major parameter measured in this experiment was the amount of the products of incomplete combustion ("PICs"), specifically, the vapors of aromatic substances.

In each of these experiments, CN-200 resin was first milled and passed through a 200-mesh sieve. In one experiment, 2.0 grams of the resin was heated in a stoppered Erlenmeyer flask equipped with an inlet tube and an outlet tube under stationary ambient air at a temperature of approximately 450° C. for 5 minutes. At the end of this period, a compressed air cylinder was used as a source of air. The air flowed through the Erlenmeyer flask at a rate of about 3.6 milliliters per second for 30 seconds. The air coming out of the flask was bubbled through a series of two test tubes, each containing 15 milliliters of n-heptane to absorb the vapors resulting from the thermal decomposition of the resin. The resulting solution was then analyzed using infrared ("IR") absorption spectrophotometry and ultraviolet ("UV")-visible absorption spectrophotometry.

Two other identical experiments were carried out with 2.0 grams of resin, premixed in each case with 1.0 gram of ferrihydrite. The corresponding spectra of the pure heptane solvent in a heptane blank were also measured.

The IR spectra was measured using a 1-millimeter thick liquid cell. FIG. 1 shows the resulting spectra 10 for the fumes absorbed from the mixture of resin with ferrihydrite, spectra 12 for the fumes absorbed from the resin in the absence of ferrihydrite, and spectra 14 for the fumes absorbed from the heptane blank. The main difference among the spectra obtained in the three measurements involved the intensity of the absorption peak at a frequency of 680 $cm^{-1}$, indicated by an arrow in FIG. 1. The intensity of the absorption peak 16 in the spectra 14 (the heptane blank) is very small while the intensity of the absorption peak 18 in the spectra 12 (without ferrihydrite) is very large. The intensity of the absorption peak 20 in spectra 10 (with ferrihydrite) is much less than that of the peak 18 in spectra 12. Comparison of the observed IR spectra with literature data showed that the absorption peaks which were largely suppressed in presence of ferrihydrite were indicative of aromatic compounds, most probably oxidized aromatic carbonyl compounds such as aromatic aldehydes, ketones, or quinones. See, for example, Conley, Robert T., *Infrared Spectroscopy*, Allyn and Bacon, Inc., 1972, pp. 157–159. Such aromatic carbonyl compounds are known to be major PICs.

Figure 2:
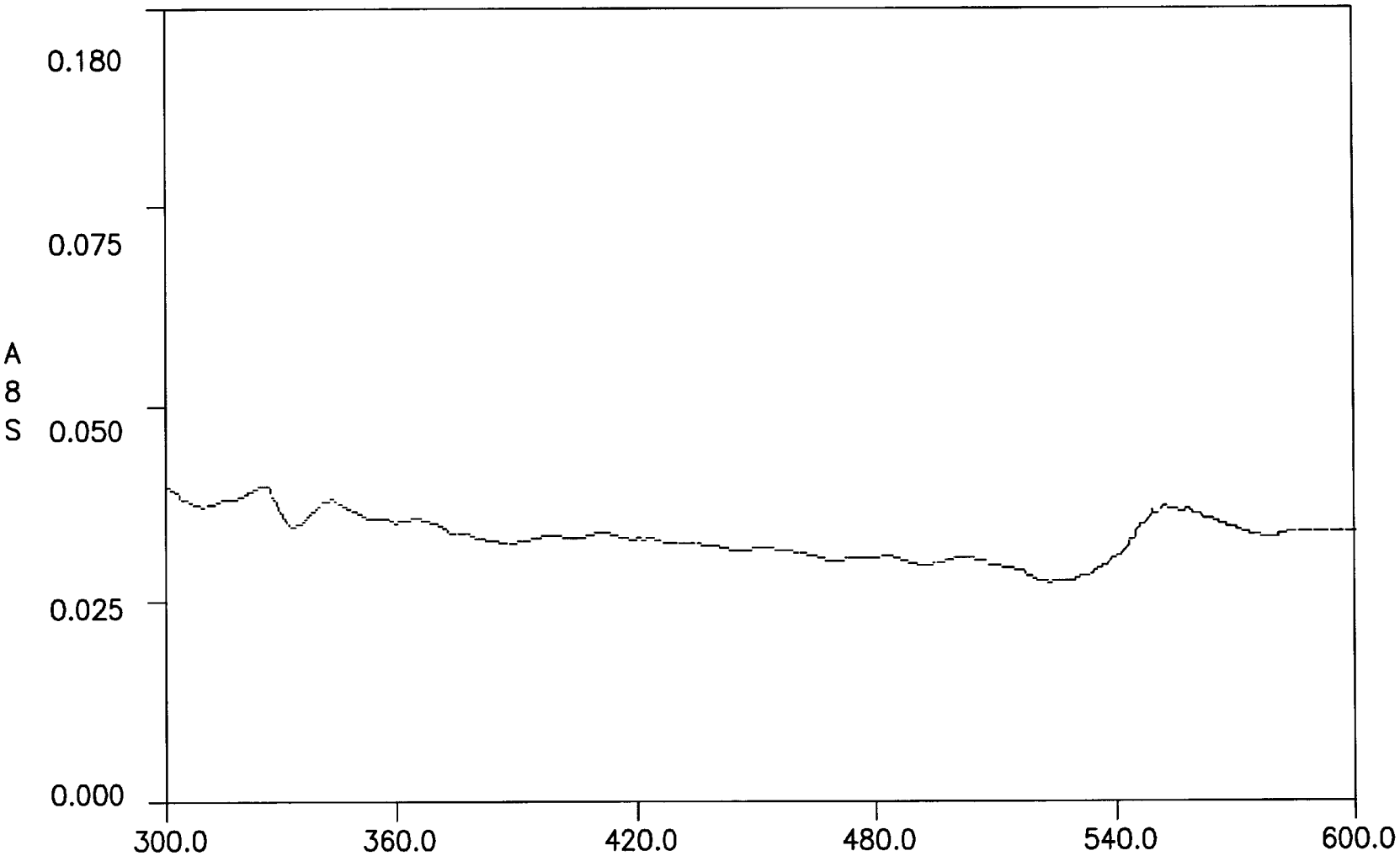
FIG. 2 is a ultraviolet ("UV")-visible absorption spectrum of a heptane blank.
Figure 3:
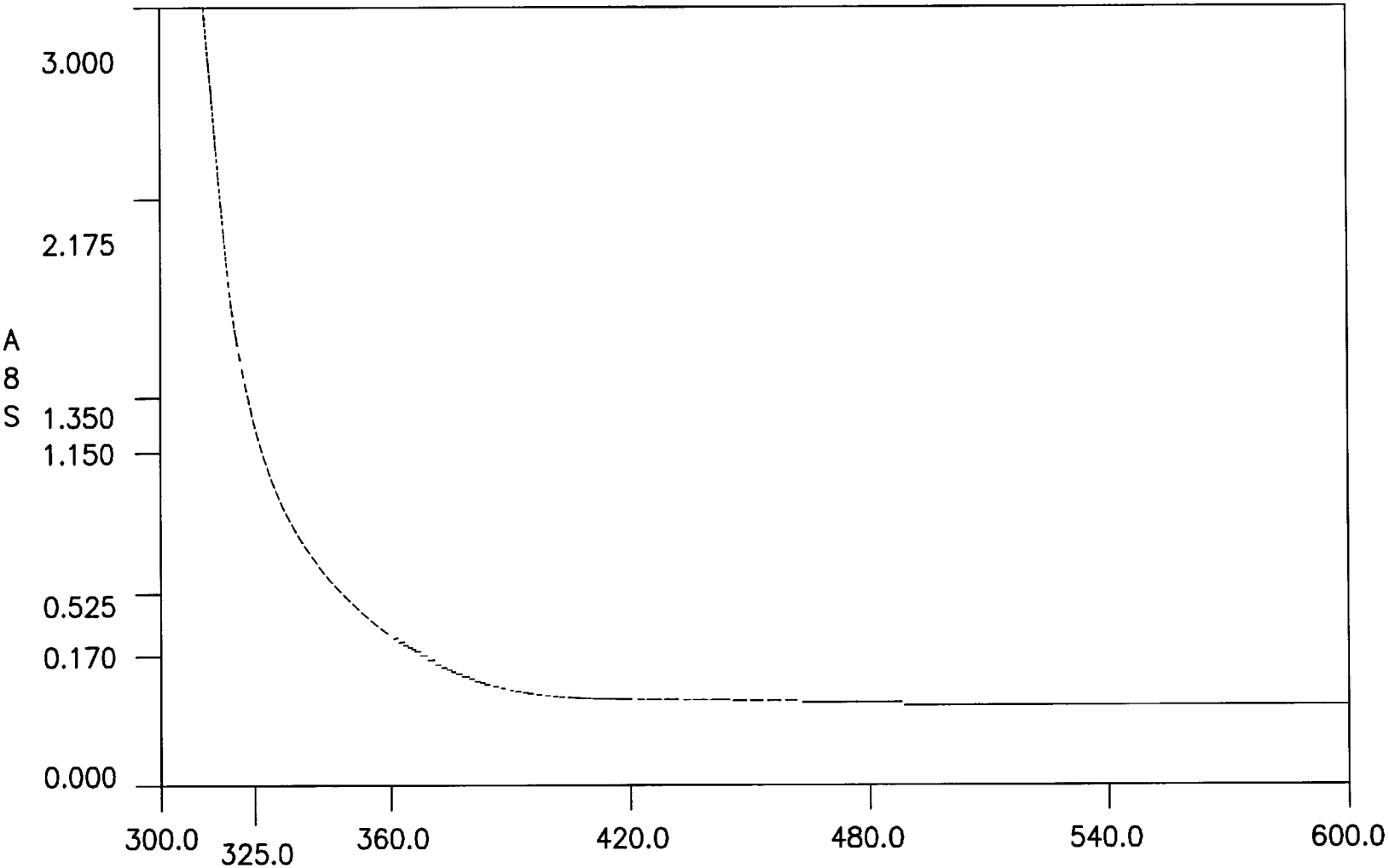
FIG. 3 is a UV-visible absorption spectrum of a solution of the fumes of thermally decomposed ion exchange resin absorbed in heptane, in the absence of ferrihydrite.
Figure 4:
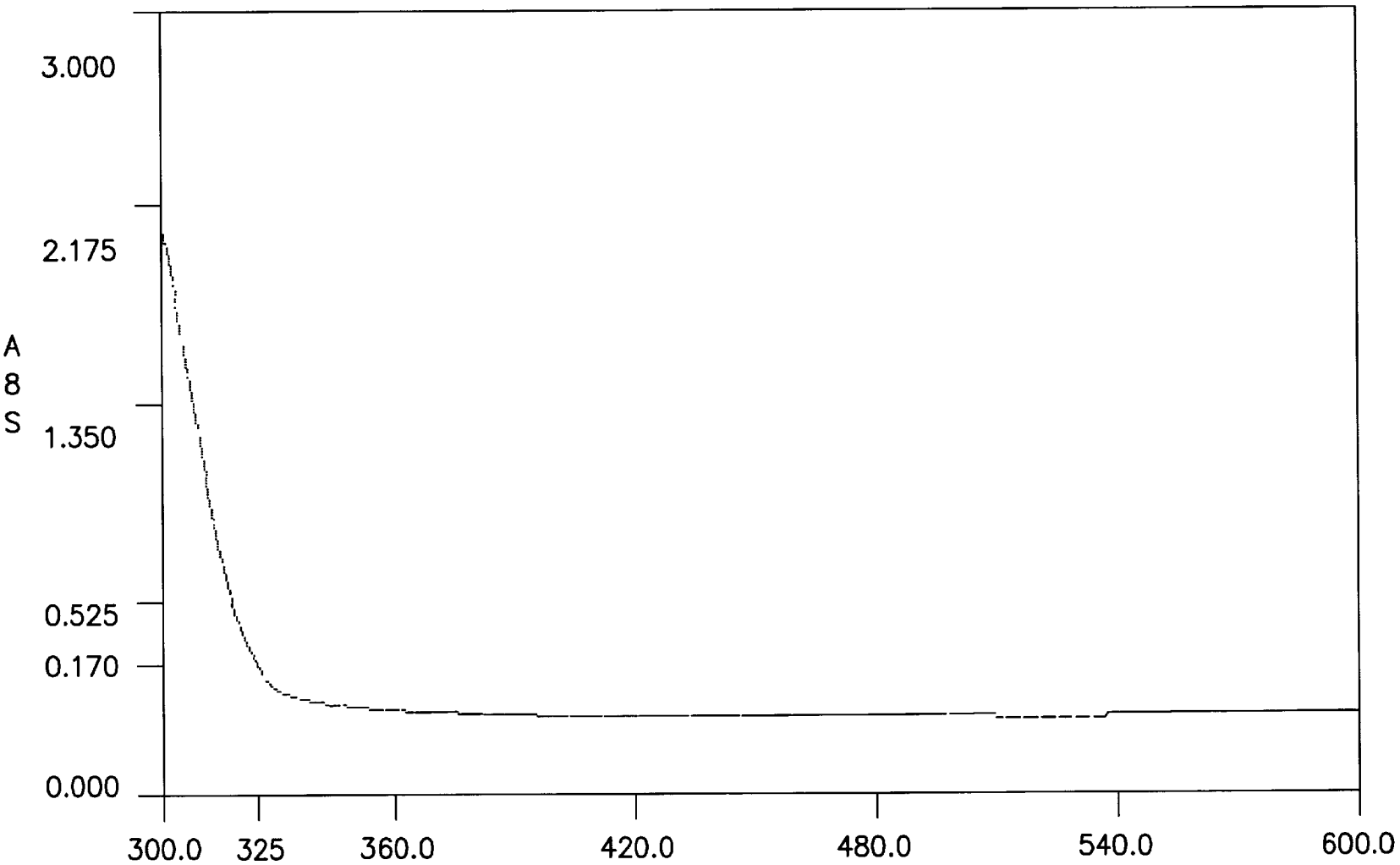
FIG. 4 is a UV-visible absorption spectrum of a solution of the fumes of ion exchange resin absorbed in heptane, thermally decomposed in the presence of ferrihydrite.

Various UV-visible spectra were obtained using a 10-millimeter cell. FIG. 2 is a UV-visible absorption spectrum of the heptane blank. FIG. 3 is a UV-visible absorption spectrum of the fumes of thermally decomposed resin in the absence of ferrihydrite. FIG. 4 is a UV-visible absorption spectrum of the fumes of resin thermally decomposed in the presence of ferrihydrite. Comparison among the various UV-visible spectra shows that the absorption of the heptane blank (FIG. 2) in the wavelength region between 300–500 nanometers ("nm") was extremely small, amounting to less than 0.04 absorbance units over this entire range. The absorption spectrum for the thermally decomposed resin in the absence of ferrihydrite (FIG. 3) shows a broad, intense absorption band gradually decreasing in intensity from 300 nm to about 450 nm. For instance, at a wavelength of 325 nm, the intensity of the band was 1.15 absorbance units. In the absorption spectrum for the resin thermally decomposed in the presence of ferrihydrite (FIG. 4), the absorption between 300 nm and 450 nm was much weaker. The intensity at a wavelength of 325 nm, for example, was only 0.17 absorbance units. Aromatic species, especially the aromatic carbonyl compounds mentioned above, are known to give rise to absorbance bands in the 300 nm–450 nm range. See, for example, *Absorption Spectra in the Ultraviolet and Visible Region*, edited by Dr. L. Lang, Academic Press, Inc., $4^{th}$ Edition, 1996, Vol. I, p. 815; Robinson, J. W., *Undergraduate Instrumental Analysis*, Marcel Dekker, Inc., $4^{th}$ Edition, 1987, p. 176. Thus, the UV-visible measurements and the IR measurements show that the presence of ferrihydrite is effective in causing a substantial reduction in the amount of undesirable PICs arising from the thermal decomposition of ion exchange resins.

IMMOBILIZATION OF CONTAMINATED MATERIALS

As described in U.S. Ser. No. 08/713,243, to immobilize contaminated materials, such as radioactive and hazardous wastes, in a matrix of ferric oxide, hydrated ferric oxide, prepared as described above, is mixed with the waste material. The mixture is then pressed while gradually reducing the water content of the mixture to consolidate the ferric oxide into a matrix surrounding the particles of the waste material, which is dispersed throughout the matrix.

If the waste material includes organic materials, a heat treatment step is preferably provided prior to pressing, as discussed above. In the case of immobilization in ferric oxide, part of the ferrihydrite required in the process is preferably added before heating and part before pressing and dehydration to produce the final hard ferric oxide product. For example, about half may be added before heating and about half before pressing. While all the hydrated ferric oxide may be added prior to heating, as shown in Example 4, below, after heat treatment, there may not be a sufficient amount of hydrated ferric oxide present for adequate consolidation upon pressing. Since the material is to be consolidated in ferric oxide, it is preferred that ferric oxide, particularly hydrated ferric oxide, be the metal oxide used in the pretreatment. Another metal oxide, such as hydrated aluminum oxide, may also be used in the heat treatment step. Preferably, heat treatment is performed at a temperature between about 200° C. to about 500° C., and more preferably at a temperature between about 300° C. to about 450° C.

It is preferred that the hydrated ferric oxide added to the heat treated mixture be "fresh", i.e., the precipitate has not been sitting for more than several days. The total water content of the mixture is preferably adjusted, if necessary, to be between about 5% to about 40% by weight of the mixture. About 10% to about 30% is preferred. Water content for the purpose of this invention includes molecular water in free, occluded or sorbed form, as well as water of hydration and hydroxyl groups. It has been found that most contaminated materials can be readily pressed into a hard, consolidated composition when the water content before pressing is between about 10%–30%.

The water content may be adjusted by sampling the mixture, heating the samples to determine the loss of weight corresponding to the water present in the samples, and calculating how much water has to be added to the mixture or removed by drying to achieve the desired water content. Since it may be difficult to stop the drying process when the preferred water content is reached uniformly throughout the mixture, it may be found preferable to dry the mixture by moderate heating to remove the free-standing water and then to add the required amount of water to reach the desired water content.

The total hydrated ferric oxide in the mixture, which includes the amount added prior to heat treatment, comprises at least about 20% $Fe_2O_3$ of the dry weight of the mixture. Preferably, the hydrated ferric oxide is greater than about 30% $Fe_2O_3$ of the dry weight of the mixture. If volume reduction is not a consideration or if the contaminated materials have particle sizes of about 50–200 microns, the hydrated ferric oxide as $Fe_2O_3$ is preferably at least about 50%, and more preferably greater than about 70% of the dry weight of the mixture. It has been found that hydrated ferric oxide of at least about 30% $Fe_2O_3$ is sufficient for consolidation of most contaminated solid material. Certain materials, such as copper and cuprous oxide ($Cu_2O$), can be consolidated with at least about 20% hydrated ferric oxide.

Preferably, the slurry of hydrated ferric oxide is mixed with the contaminated materials after filtration of the slurry to reduce the amount of contaminated water developed by the process. Soluble materials, such as cesium nitrate and cobalt nitrate, for example, must be added after filtration.

Pressure may be applied by any of a variety of techniques which permit the removal of water as water vapor. For example, uniaxial pressing, isostatic pressing or pressure roller systems can be adapted to enable the removal of water vapor, as described in U.S. Ser. No. 08/713,243.

During pressing, the water content is preferably reduced to a final level of about 0.1–10.0% for adequate consolidation. A final water content of about 2.0% to about 7.0% is preferred. It is believed that after pressing, at least a majority of the ferric oxide in the resulting solid, consolidated composition comprises hydrohematite. It is also believed that most of the water present in the solid composition is in the form of water of hydration or hydroxyl groups.

The pressing and water removal step is conducted for a period of time necessary to consolidate the mixture into a solid composition at a particular pressure and temperature, as described in U.S. Ser. No. 08/713,243.

Since the pressure, temperature and duration of the pressing step will impact the costs of the procedure, these factors would be balanced in a commercial implementation. Preferably, this step is conducted at room temperature, although higher temperatures may be used. For example, temperatures up to 150° C. may also be used. Temperatures above 150° C. may also be used, as described in U.S. Ser. No. 08/713,243.

A pressure of about 70,000 psi may be applied for consolidation. Preferably, additives are provided to the mixture prior to pressing to lower the required pressure, preferably to below 30,000 psi and more preferably to below 15,000 psi. Such additives include metal oxides, such as magnesium oxide, aluminum oxide, cupric oxide and zinc oxide, metallic iron powder, ceramic binders, alumina, silica, silicates, aluminosilicates, phosphates, phosphoric acid, titania, and titanates, for example. These additives can reduce the required pressure, temperature or duration of the pressing process. Magnesium oxide and ammonium dihydrogen phosphate are preferred additives for lowering the pressure, the temperature and/or the duration of the pressing process. The weight ratio of the ammonium dihydrogen phosphate to the ferrihydrate is preferably in the range of from about 0.3 to about 3. The weight ratio of magnesium oxide to ferrihydrite is preferably in the range of about 0.1 to about 4. Preferably, both magnesium oxide and ammonium dihydrogen phosphate are used together. When used together, the weight ratio of ammonium dihydrogen phosphate to magnesium oxide is preferably in the range of from about 2 to about 6, more preferably from about 3 to about 5. Concentrated phosphoric acid is another preferred additive.

Certain additives, such as calcium phosphate and magnesium phosphate, may also improve the hardness and strength of the solid body. Such species can be incorporated into the product by co-precipitation, mixing, or both, with the hydrated ferric oxide. A fine particulated material suspended in water, such as silica gel, magnetite or cuprite, can also be added to the slurry after most of the water has been removed by filtration.

The amount of additives should not lower the ferric oxide content of the solid composition below about 20%. The preferred percentages of ferric oxide discussed above are also applicable when additives are included. The total amount of other solid species which can be added to the hydrated ferric oxide without changing the mechanical properties of the consolidated composition can be up to about 80%, depending on the quantity, composition and particle size of the contaminated material.

If it is desired to conduct the pressing step at a temperature higher than room temperature, hot uniaxial pressing ("HUP") and hot isostatic pressing ("HIP") are preferred hot pressing techniques which are routinely used in the ceramic industry and have been proposed for use in large-scale processing of nuclear waste. See, for example, F. J. Ackerman et al., Mat. Res. Soc. Symp. Proc., Vol. 15, pp. 63–70 (1983) ("Ackerman"); U.S. Pat. No. 5,073,305 to Miyao et al. ("Miyao"); and U.S. Pat. No. 4,642,204 to Burström et al. ("Burström"), which are incorporated by reference herein. HUP and HIP are also described in U.S. Ser. No. 08/713,243. Such devices may be used at room temperature, as well.

The densified, consolidated, solid composition formed by uniaxial pressing may be removed and placed in a containment vessel, such as a can or drum, for underground burial or other such disposal. Cans or drums for contaminated material disposal are typically available in 55, 30, 20 and 8 gallon sizes. In the case of isostatic pressing, the product is usually already enclosed within a can as it is removed from the press. Because of its hardness, strength, and resistance to leaching and crushing, the consolidated composition containing the waste materials will maintain its integrity even if the containment vessel is broken or disintegrates. The immobilized radioactive and hazardous materials will not, therefore, disperse into the air or ground water. The use of immobilization in ferric oxide may remove the necessity for containment in a high integrity container for certain wastes.

When both a heat treatment of 450° C. and high pressures (about 70,000 psi) are used in the immobilization of ion exchange resins, volume reduction of at least about 12 times is possible. At lower pressures, such as about 14,000–25,000 psi, for example, with heat treatment of about 450° C., prior to pressing, volume reductions of about 4–5 may be achieved. Without the heat treatment, volume reductions of only about 2 times can be obtained at lower pressures. While higher pressures enable greater volume reductions, thereby lowering burial costs, the processing costs are higher. The heat treatment, by enabling sufficient volume reduction for economic burial costs, enables the use of much lower pressures, enabling significant savings in processing costs.

EXAMPLE 3

A mixture of 1.0 gram of CN-200 cation exchange resin was mixed with 0.5 grams of ferrihydrite, prepared as described above, and heated at 450° C. for 30 minutes. Quantities of 0.5 grams of ammonium dihydrogen phosphate ($NH_4H_2PO_4$) and 0.1 grams of magnesium oxide (MgO) were added and the mixture was loaded into to a die. A volume of 0.12 milliliter of water was added to adjust the water content. Concentrated phosphoric acid (85% $H_3PO_4$) can be added instead of or along with water. The mixture was pressed at 25,000 psi and approximately 200° C. Hard, consolidated pellets were obtained. Hard, consolidated pellets were also obtained at pressing temperatures of about 170–180° C. Volume reduction of 5–6 times were obtained.

Pellets of equally good quality were obtained when the ferrihydrite was replaced by hydrated aluminum oxide, as well.

EXAMPLE 4

A quantity of 91.28 grams of CN-200 cation exchange resin was mixed with a solution containing 30 grams of cobalt nitrate hexahydrate ($Co(NO_3)_2 6H_2O$) in 300 milliliters of deionized water by stirring for three hours. 13 milliliters of the resin, weighing 9.1 grams, was dried at 60° C. for 16 hours. It was then mixed with 1.0 gram of ferrihydrite and pre-heated for 30 minutes at 450° C. mixture was cooled to room temperature and mixed with 1.25 grams of additional ferrihydrite, 2.25 grams of ammonium dihydrogen phosphate ($NH_4H_2PO_4$) and 0.5 grams of magnesium oxide (MgO). 0.6 milliliters of deionized water was added to adjust the water content.

The mixture was placed in a die with a diameter of 30 millimeters and pressed for 90 minutes at a pressure of 13,700 psi while connected to a vacuum line. The temperature was not increased above room temperature, which was about 21° C. to about 22° C.

The resulting pellet was hard, strong and resistant to disintegration in water. The weight of the pellet was 6.4 grams and its volume was 2.8 milliliters, corresponding to a volume reduction factor of 4.6.

In this example, the temperature of the process was reduced to room temperature, the duration of the pressing step was reduced to 90 minutes, and the pressure was reduced to 13,700 psi, all of which would contribute to a significant reduction in processing costs in a commercial process. The volume reduction was sufficient for acceptable burial costs. It is probable that the use of magnesium oxide, ammonium dihydrogen phosphate and phosphoric acid, individually or in combination, as additives to ferrihydrite or hydrated aluminum oxide, may provide for effective immobilization of the wastes in a hard solid at pressures as low as about 5,000 psi, or lower. Other additives may enable consolidation at such low levels, as well. Temperatures in the range of from about 15° C. to about 30° C. are considered "room temperature".

Radioactive and hazardous species dissolved or suspended in aqueous solutions may also be immobilized by precipitating hydrated ferric oxide in the aqueous solution to incorporate some or a substantial fraction of the species. The water content of the resulting hydrated ferric oxide mixture is adjusted and the mixture is pressed at room temperature, as described above, to produce a hard, solid composition. The contaminants may be incorporated by co-precipitating, sorbing or both, with the ferric oxide. Volume reduction of several hundred times is possible for contaminated aqueous solutions.

Ferric oxide can be precipitated by adding a base and a solution of a ferric salt to the aqueous solution of contaminated waste. The water content can be adjusted, if necessary. Additives may be provided to lower the required pressure, and other parameters of the process, as described, above. Preferably, pressing is conducted at less than about 30,000 psi, and more preferably, less than about 15,000 psi. These steps of the procedure are all discussed above with respect to the first embodiment of the invention.

We claim:

1. A process of heat treating of organic materials in the presence of air or oxygen, comprising;

mixing the organic materials with a hydrated metal oxide; and heating the mixture.

2. The process of claim 1, comprising mixing the hydrated metal oxide with organic materials chosen from the group consisting of organic solid hazardous wastes, organic solid radioactive wastes and organic solid municipal wastes.

3. The process of claim 1, comprising mixing the hydrated metal oxide with organic materials chosen from the group consisting of polymers, plastics, ion exchange resins and polymeric sorbents.

4. The process of claim 1, comprising mixing the organic materials with a hydrated ferric oxide.

5. The process of claim 4, further comprising immobilizing the heated mixture in a matrix of ferric oxide.

6. The process of claim 5, comprising pressing the heated mixture while under pressure for a period of time to immobilize the organic solids in a solid composition.

7. The process of claim 5, comprising pressing the heated mixture at room temperature.

8. The process of claim 5, comprising pressing the heated mixture at a pressure less than about 30,000 psi.

9. The process of claim 4, comprising mixing the organic materials with ferrihydrite.

10. The process of claim 1, comprising mixing the organic materials with hydrated aluminum oxide.

11. The process of claim 1, further comprising forming the hydrated metal oxide by precipitating the hydrated metal oxide from a solution comprising a metal salt, by mixing the solution with a base, prior to the mixing step.

12. The process of claim 1, further comprising immobilizing the heat treated mixture in a material chosen from the group consisting of cement, concrete, a polymer, bitumen and glass.

13. The process of claim 1, wherein the heating step is part of a process chosen from the group consisting of incineration and thermal decomposition.

14. The process of claim 1, comprising heating the mixture at a temperature of at least about 300° C.

15. The process of claim 1, comprising heating the mixture up to a temperature of about 500° C.

16. The process of claim 1, comprising mixing the hydrated metal oxide and the organic materials prior to the start of thermal decomposition of the organic materials.

17. The process of claim 1, comprising heating the organic materials to a temperature causing thermal decomposition of the organic material.

18. A process for immobilizing contaminated materials including organic materials, comprising:

mixing the contaminated materials with hydrated ferric oxide;

heating the mixture at a temperature to cause thermal decomposition of the organic materials; and pressing the heated mixture and gradually removing a large part of the water present in the mixture while under pressure for a period of time to produce a solid composition.

19. The process of claim 18, comprising pressing the heated mixture at room temperature.

20. The process of claim 18, comprising pressing the heated mixture at a pressure less than about 30,000 psi.

21. The process of claim 20, further comprising adding at least one material chosen from the group consisting of a metal oxide, metallic iron powder, a ceramic binder, a silica, a silicate, an aluminosilicate, a phosphate, phosphoric acid, titania and a titanate, prior to pressing.

22. The process of claim 20, further comprising adding magnesium oxide and ammonium dihydrogen phosphate, prior to pressing.

23. The process of claim 22, comprising adding magnesium oxide such that the weight ratio of magnesium oxide to hydrated ferric oxide is between about 0.1 to about 4, and adding ammonium dihydrogen phosphate such that the weight ratio of ammonium dihydrogen phosphate to hydrated ferric oxide is between about 0.3 to about 3.

24. The process of claim 18, further comprising adding additional hydrated ferric oxide to the heated mixture prior to pressing, such that the mixture comprises at least about 20% $Fe_2O_3$ by dry weight of the total weight of the mixture.

25. A process for immobilizing contaminated materials including organic materials, comprising:

mixing the contaminated materials with a metal oxide;

heating the mixture to cause thermal decomposition of the organic materials;

adding hydrated ferric oxide to the heated mixture; and pressing the heated mixture and gradually removing a large part of the water present in the mixture for a period of time to produce a solid composition.

26. The process of claim 25, comprising mixing the contaminated materials with a hydrated metal oxide.

27. The process of claim 25, comprising mixing the contaminated materials with hydrated ferric oxide.

28. The process of claim 25, comprising mixing the contaminated materials with hydrated aluminum oxide.

29. The process of claim 25, comprising pressing the heated mixture at room temperature.

30. The process of claim 25, further comprising adding at least one material chosen from the group consisting of a metal oxide, aluminum oxide, cupric oxide, zinc oxide, metallic iron powder, a ceramic binder, a silica, a silicate, an aluminosilicate, a phosphate, phosphoric acid, titania and a titanate, prior to pressing.

31. The process of claim 25, further comprising adding magnesium oxide and ammonium dihydrogen phosphate, prior to pressing and pressing at less than about 15,000 psi.

32. The process of claim 25, wherein the hydrated ferric oxide comprises at least about 20% $Fe_2O_3$ by dry weight of the total weight of the mixture.

33. A process for immobilizing contaminated materials, comprising:

mixing the contaminated materials with hydrated ferric oxide, comprising at least about 20% $Fe_2O_3$ by dry weight of the total weight of the mixture; and pressing the mixture at room temperature and gradually removing a large part of the water present in the mixture while under pressure for a period of time to produce a solid composition.

34. The process of claim 33, comprising pressing the mixture at a pressure less than about 30,000 psi.

35. The process of claim 33, comprising adding to the mixture at least one material chosen from the group consisting of a metal oxide, metallic iron powder, a ceramic binder, a silica, a silicate, an aluminosilicate, a phosphate, phosphoric acid, titania and a titanate, prior to pressing.

36. The process of claim 34 comprising adding to the mixture magnesium oxide and ammonium dihydrogen phosphate and pressing at less than about 15,000 psi.

37. A process for immobilizing contaminated materials contained in an aqueous solution, comprising:

precipitating hydrated ferric oxide in the solution to incorporate at least a fraction of the contaminated materials, wherein the hydrated ferric oxide comprises at least about 20% $Fe_2O_3$, by dry weight of the total weight of the precipitate; and pressing the precipitate at room temperature and gradually removing a large part of the water while under pressure for a period of time to produce a solid composition containing the contaminated materials.

38. The process of claim 37, further comprising adding to the resulting precipitate at least one material selected from the group consisting of a metal oxide, metallic iron powder, a ceramic binder, alumina, a silicate, an aluminosilicate, a phosphate, phosphoric acid, titania and a titanate before pressing.

39. The process of claim 37, wherein the pressing step is conducted at a pressure of less than about 30,000 psi.

40. A process for immobilizing contaminated materials, comprising:

mixing the contaminated materials with a metal oxide;

heating the mixture;

thermally decomposing the mixture; and immobilizing the heated mixture.

41. The process of claim 40, comprising immobilizing the heated mixture in a material chosen from the group consisting of cement, concrete, ferric oxide, a polymer, bitumen and glass.

42. The process of claim 41, packaging the material in a storage container.

43. The process of claim 40, comprising heat treating the mixture at a temperature of at least about 300° C.

44. The process of claim 40, comprising heating the mixture up to a temperature of about 500° C.

45. A process for processing contaminated materials including organic materials, comprising:

mixing the contaminated materials with a hydrated metal oxide;

heating the mixture;

thermally decomposing the mixture; and containing the heated mixture in a high integrity container.

46. The process of claim 45, wherein the heating step is chosen from the group consisting of incineration and thermal decomposition.

* * * * *

UNITED STATES PATENT AND TRADEMARK OFFICE

CERTIFICATE OF CORRECTION

PATENT NO. : 6,288,300 B1
DATED : September 11, 2001
INVENTOR(S) : Miriam Lemus et al.

It is certified that error appears in the above-identified patent and that said Letters Patent is hereby corrected as shown below:

Column 10,
Line 36, please start a new paragraph after "450°C." and add -- The -- before "mixture" so that the new paragraph begins "The mixture was cooled to room temperature".

Signed and Sealed this

Twenty-first Day of May, 2002

*Attest:*

*Attesting Officer*

JAMES E. ROGAN
*Director of the United States Patent and Trademark Office*